US005265817A

United States Patent [19]

Gaudin

[11] Patent Number: 5,265,817

[45] Date of Patent: Nov. 30, 1993

[54] BRAKING DEVICE FOR CONTINUOUS SLITTED BANDS

[75] Inventor: Jean Gaudin, Montigny les Cormelles, France

[73] Assignee: Auxmet, Neuilly En Thelle, France

[21] Appl. No.: 884,477

[22] Filed: May 12, 1992

Related U.S. Application Data

[63] Continuation of Ser. No. 606,175, Oct. 31, 1990, abandoned.

[30] Foreign Application Priority Data

Nov. 8, 1989 [FR] France ..... 89 14663

[51] Int. Cl.[5] ..... B65H 23/16; B65H 23/26

[52] U.S. Cl. ..... 242/56.9; 242/75.2; 226/195

[58] Field of Search ..... 242/56.2, 56.9, 75, 242/75.2; 226/195; 188/264 CC

[56] References Cited

U.S. PATENT DOCUMENTS

| | | | |
|---|---|---|---|
| 3,046,823 | 7/1962 | Cole | 242/56.2 |
| 3,386,679 | 6/1968 | Foulon et al. | 242/75.2 |
| 3,468,494 | 9/1969 | Gaudin | 242/75.2 |
| 3,547,332 | 12/1970 | Gaudin | 242/75.2 |
| 3,666,195 | 5/1972 | Gaudin | 242/75.2 |
| 3,735,937 | 5/1973 | Plantard | 242/75.2 |
| 3,854,672 | 12/1974 | Tilban | 242/75.2 |
| 4,026,491 | 5/1977 | Bostroem | 242/56.9 |
| 4,103,839 | 8/1978 | Arimatsu | 242/75.2 |
| 4,218,029 | 8/1980 | Schwenzfeier et al. | 242/56.9 |
| 4,347,962 | 8/1982 | Uphues | 242/75.2 |
| 4,378,060 | 3/1983 | Meronge et al. | 188/264 CC |

FOREIGN PATENT DOCUMENTS

| | | | |
|---|---|---|---|
| 2120496 | 2/1972 | Fed. Rep. of Germany | 242/75.2 |
| 2404360 | 9/1974 | Fed. Rep. of Germany | 242/75.2 |
| 2123885 | 9/1972 | France | 242/75.2 |
| 56-82755A | 7/1981 | Japan | 226/195 |
| 56-136748A | 10/1981 | Japan | 242/75 |
| 58-144042A | 8/1983 | Japan | 242/75 |
| 63-17761A | 1/1988 | Japan | 226/195 |
| 1-130817A | 5/1989 | Japan | 242/75 |
| 2-52844A | 2/1990 | Japan | 242/75 |

*Primary Examiner*—Daniel P. Stodola
*Assistant Examiner*—John Q. Nguyen
*Attorney, Agent, or Firm*—Pollock, Vande Sande & Priddy

[57] ABSTRACT

A band slitting installation including a tensioning device allowing braking simultaneously and without friction an assembly of bands which are presented for being wound on the same drum, wherein the necessary braking effort is transmitted to two endless belt webs between which pass the slitted bands so that the belts can move at different speeds, respectively equal to the speeds of the slitted bands to the braked, characterized in that the braking efforts are on the one hand applied directly on the belts of the upper web via an upper clamping plate and on the other hand, on the lower web via a lower clamping plate made of a plurality of tubes the number and the upper surface of which are identical to those of the belts, whereby the tubes are covered with a wear resisting sheet of great hardness, transmitting the braking effort to the belts of the lower web.

5 Claims, 1 Drawing Sheet

BRAKING DEVICE FOR CONTINUOUS SLITTED BANDS

This application is a continuation of Ser. No. 07/606,175 filed on Oct. 31, 1990, now abandoned.

FIELD OF THE INVENTION

The present invention relates to band slitting installations and it pertains more particularly to a device applying a counter-traction uniformly distributed on an assembly of bands being wound onto the same drum.

BACKGROUND OF THE INVENTION

The most common application of this device is envisaged for the winding of bands incoming from a metal slitting line, notably of metals having a fragile surface.

The slitting of wide bands, of a generally metallic material, consists in cutting a band which is wound on a reel in the direction of its length, meaning that one starts from a long sheet of a great width so as to form sheets of the same length but of a small width.

A standard slitting installation includes generally, as shown in FIG. 1 of the accompanying drawing:

a paying out reel 1, a deflector roller 2, a shearing tool, for example with multiple cutter wheels 3, a reel 4.

It should be remarked that the fact of cutting longitudinally a band of great width does not allow presenting, on the winding reel mandrel, bands which are stretched in an equal manner, and this because of the possible differences of thickness between the center and the edges of the band or also due to the inner tensions of the wide band released by the slitting operation. On the other hand, when being wound, each of the coils made has to be separated from the adjacent one by mechanical means so as to avoid an overlapping of bands. If this operation is made while the bands are under tension, the edges of the slitted bands are generally damaged.

BRIEF DESCRIPTION OF THE INVENTION

The present invention proposes providing a compact device allowing first to solve the hereabove mentioned difficulties and allowing the making of coils during the winding step without collision.

On the other hand, it is very important not to damage the surface of the products used on a slitting equipment. At worse, if one can use a simple press prior to the winding reel for hot-rolled steels for example, this technique is absolutely excluded:

for cold-rolled steels, with a fragile surface, for metals which are coated or painted, for bright stainless materials, for aluminiums, etc. . .

The device of the invention is used necessarily on a so-called "with a loop" line the cinematics of whch have been known for long, meaning that the shearing tool feeds the bands into a trough prior to being presented to winding. The effect of this technique is to enhance the separation of the bands while they are without tension when coming out from the trough. This separation is carried out by a rectilinear or rotating separator, which is a known assembly, denoted by reference 5 in FIG. 1.

Between this separator 5 and the reel 4 is placed the device of the invention which has been shown schematically in FIG. 1 and is generally denoted by reference 6.

Band slitting installations including a tensioning device for making simultaneously and without friction an assembly of bands presented for winding on the same drum are already known, wherein the necessary braking effort is transmitted to two endless belt webs between which pass the bands so that the belts can move at different speeds, respectively equal to the speeds of the slitted bands which have to be braked.

The experience resulting from using these known installations shows that they exhibit the disadvantage resulting from wear of the belts of the tensioning device. Indeed, one sees that these belts wear out in an unequal manner in thickness, notably due to:

the different speeds, the web of belts corresponding in width to the maximum width of the web of slitted bands, and this possibility of a maximum width not being always used, the result being that it is always the same belts which are stressed and which correspond to the band web of maximum width.

The result is a very unequal wear of the braking device belt assembly and consequently the braking of the bands is not constant after a short period of use, thereby compelling the frequent change of belts.

The invention proposes remedying these disadvantages by providing a band slitting installation including a tensioning device allowing braking simultaneously and without friction an assembly of bands which are presented for being wound on the same drum, wherein the necessary braking effort is transmitted to two endless belt webs between which pass the slitted bands so that the belts can move at different speeds, respectively equal to the speeds of the slitted bands to be braked, this installation being characterized in that the braking effort is on the one hand applied directly on the belts of the upper web via an upper clamping plate and on the other hand on the lower web via a lower clamping plate made of a plurality of tubes the number and the upper surface of which are identical to those of the belts, whereby said tubes are covered with a wear resisting sheet of great hardness, transmitting the braking effort to the belts of the lower web.

According to a preferred embodiment of this invention, the wear resisting sheet which is part of the lower clamping plate is a stainless steel sheet and it is stretched longitudinally on the tubes which are part of the lower plate, the mounting being made in such manner as to be able to easily replace this wear resisting sheet.

According to a preferred embodiment of this invention, the upper braking plate is made in the form of a hollow caisson in which flows a cooling fluid, notably water, and the tubes forming the lower clamping plate have a square rectangular section and a cooling fluid such as water flows through them.

According to the invention, the clamping effort is transmitted to the two upper and lower braking plates, via an inflatable chamber interposed underneath said lower plate and the frame of the installation, this chamber being preferably of a toric shape, made of a deformable polymer and fed by a compressed air generator the pressure of which is set so as to vary at will the braking value.

Other features and advantages of this invention will become more apparent from the hereafter description with reference to the accompanying drawings illustrating an embodiment thereof, having no limiting character, wherein

DETAILED DESCRIPTION OF THE INVENTION

Figure 1:
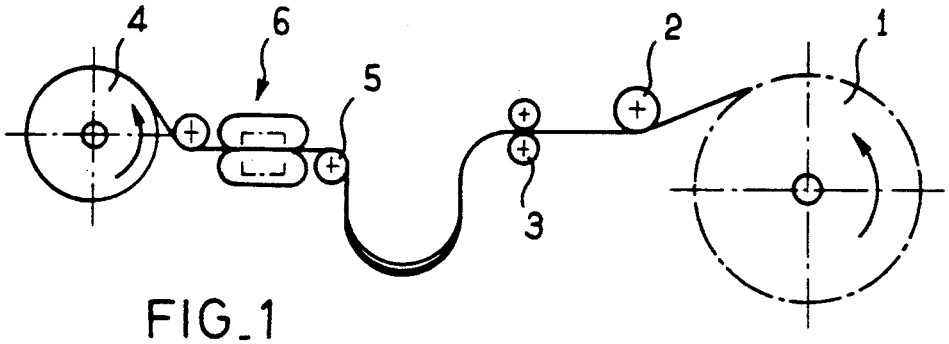
FIG. 1 is a schematic view showing as a whole the slitting line briefly described in the hereabove statement and in which is implanted the device 6 according to the invention.
Figure 2:
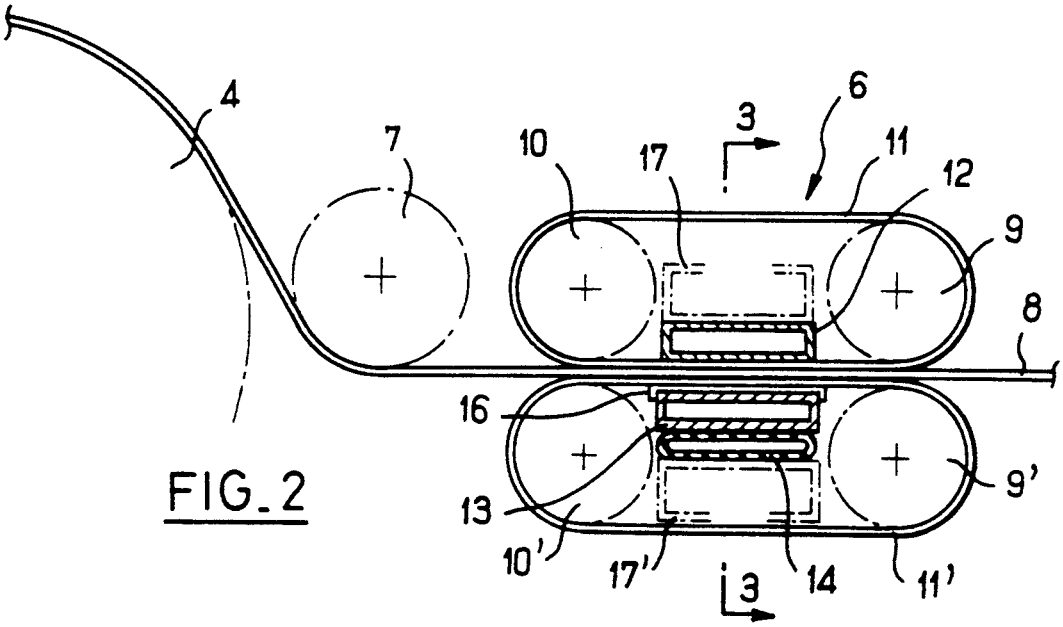
FIG. 2 is an elevation schematic view showing the device which is the object of the invention.

With reference to FIG. 1 of the drawing, the device which is the object of this invention has been denoted by reference 6. In FIG. 2, device 6 is shown in a more detailed manner, and one sees that the slitted bands 8 are pinched by the belt webs 11, 11', then deflected by a deflector roller 7 prior to being wound on reel 4. As may be seen in the drawing, the belts of each of the belt webs 11 and 11' are made of a plurality of elements of small width, for example of the order of 15 to 50 mm according to needs. These belts are wound onto pullies 9, 10 and 9', 10' respectively. Of course, the belts are guided sideways by any known appropriate device so as to obtain a correct winding.

As stated hereabove, the invention provides means for transmitting a braking effort to the two belt webs 11 and 11' for braking simultaneously and without friction the assembly of slitted bands 8 which is presented for being wound onto reel 4. This braking or friction effort is applied on the belts as such, in correspondence with the clamping position of the latter on bands 8.

Figure 3:
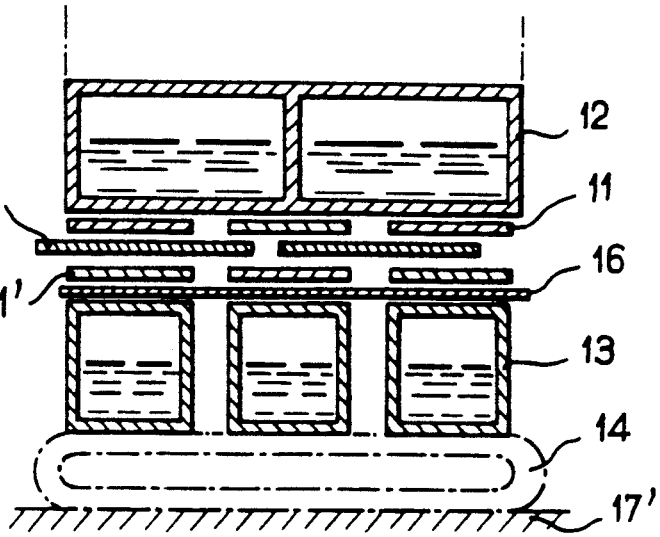
FIG. 3 is a sectional view along line 3—3 of FIG. 2, at a larger scale.

This braking device is shown in a more detailed manner in FIGS. 2 and 3. It includes substantially an upper clamping plate 12, supported by frame 17 and a lower clamping plate 13, 16. The upper clamping plate 12 is made in the form of a hollow caisson inside which can flow a cooling fluid such as water, the lower plane surface of this clamping plate 12 situated opposite the web of belts 11 being applied directly on the upper face of these belts 11 so as to transmit the braking effort to the slitted bands 8 via these belts. The lower clamping plate 13 includes a plurality of independently moveable tubes, the number and upper surface of which (braking active surface) being identical to those of the belt of web 11' (as may be seen in FIG. 3), the tubes of lower clamping plate 13 being covered with a wear resisting sheet 16, of great hardness, adapted for transmitting the braking effort to the belt web 11'. This braking effort is applied on the tubes of clamping plate 13 via a membrane or inflatable chamber 14 interposed between tubes of clamping plate 13 and frame 17' of the device. In this embodiment, tubes of clamping plate 13 are of a square section, with their upper surface corresponding to that of the belt web 11' to be braked and through which flows a cooling fluid, notably water. The wear resisting sheet 16 can be made in the form of a stainless steel sheet, of small thickness, having a good coefficient of friction and of great hardness, for example of 62 HRC. This wear resisting sheet is stretched longitudinally on tubes of clamping plate 13, as may be seen in FIGS. 2 and 3, this mounting being provided so that one is able to easily replace this wear resisting sheet.

The inflatable chamber 14 which transmits the braking effort to the upper and lower braking plates is preferably of a toric shape and is made notably of a deformable polymer. This chamber can be inflated with compressed air delivered by a generator the pressure of which is set so as to vary at will the braking value.

The particular configuration of the lower braking plate allows an easy adaptation to the various thicknesses of bands 8 which have to be braked individually and then wound onto reel 4. The aforementioned disadvantage of a very unequal wear of the parts forming the braking plates of the presently made installations does not exist with the described device according to the invention, due to the novel design of the lower braking plate, and there is thus obtained an excellent behavior of the belt webs 11 and 11' which allow doubling and even tripling operation life.

Of course, the present invention is not limited to the embodiments described and shown here and it encompasses all the variants thereof.

I claim:

1. A braking assembly for a slitted band undergoing winding comprising:

a stationary clamping member positioned in confronting relation to a first surface of the slitted band;

a plurality of adjacently spaced, non-contacting clamping members, each being free to move without interference from another and in a direction perpendicular to band travel so as to accommodate band sections of varying thickness, the moveable clamping members having clamping surfaces positioned in confronting relation to a second surface of the slitted band;

a first continuous belt having laterally spaced adjacent webs different in number from sections of the slitted band, a section of the belt intermediately positioned between the stationary clamping member and the first slitted band surface;

a second continuous belt including the same number of adjacent webs as the first, and transversely aligned therewith, the second belt having a section intermediately positioned between the moveable clamping members and the second surface of the slitted band, the clamping surfaces of the moveable clamping members being aligned with correspondingly positioned webs of the first and second belts;

a sheet of wear-resistant material mounted on the clamping surfaces of the moveable clamping members; and an inflatable member positioned on a fixed surface and contacting second surfaces of the moveable clamping members, opposite the clamping surfaces thereof, for supporting the moveable members;

wherein inflation of the inflatable member increases contact between the slitted band and both the stationary and moveable clamping members.

2. The braking assembly set forth in claim 1 wherein the stationary clamping member is hollow to permit the circulation of a coolant therethrough.

3. The braking assembly set forth in claim 1 wherein the moveable clamping members are hollow to permit the circulation of a coolant therethrough.

4. The braking assembly set forth in claim 1 wherein the wear resistant sheet is made of stainless steel and is removably mounted to the moveable clamping members.

5. The braking assembly set forth in claim 1 wherein the inflatable member has a toroidal shape.

* * * * *